US010517444B1

(12) United States Patent
Hernandez et al.

(10) Patent No.: US 10,517,444 B1
(45) Date of Patent: Dec. 31, 2019

(54) PAPER ROLL DISPENSING DEVICE

(71) Applicants: Carlos Hernandez, Hialeah, FL (US); Miguel Hernandez, Pembroke Pines, FL (US)

(72) Inventors: Carlos Hernandez, Hialeah, FL (US); Miguel Hernandez, Pembroke Pines, FL (US)

( * ) Notice: Subject to any disclaimer, the term of this patent is extended or adjusted under 35 U.S.C. 154(b) by 0 days.

(21) Appl. No.: 16/253,053

(22) Filed: Jan. 21, 2019

(51) Int. Cl.
*A47K 10/36* (2006.01)
*A47K 10/32* (2006.01)
*A47K 10/38* (2006.01)

(52) U.S. Cl.
CPC ..... *A47K 10/3687* (2013.01); *A47K 10/32* (2013.01); *A47K 10/36* (2013.01); *A47K 10/3827* (2013.01); *A47K 2010/3253* (2013.01); *A47K 2010/3681* (2013.01)

(58) Field of Classification Search
CPC ..... A47K 10/32; A47K 10/34; A47K 10/36; A47K 10/3687; A47K 10/3827; A47K 2010/3681; A47K 2010/3253; A47K 10/3643; A47K 10/3637; B65H 19/00; B65H 19/10; B65H 19/12
USPC ..... 242/560, 560.1, 560.2
See application file for complete search history.

(56) References Cited

U.S. PATENT DOCUMENTS 2,407,971 A * 9/1946 Black ..... A47F 1/08 312/34.22
2,592,346 A * 4/1952 Scogin ..... A47F 1/08 242/558
2,603,427 A * 7/1952 Holmes ..... A47K 10/38 242/558
2,605,975 A * 8/1952 Page ..... A47K 10/22 242/560.3
2,738,934 A * 3/1956 Dobkin ..... A47K 10/3687 242/560.1
2,896,871 A * 7/1959 Woodruff ..... A47K 10/22 242/560.3
2,974,839 A * 3/1961 Batlas ..... A47K 10/3687 225/12
3,039,709 A * 6/1962 Bolger ..... A47K 10/32 242/560.3
3,058,682 A * 10/1962 Mott ..... A47K 10/3687 242/560.3
3,130,932 A * 4/1964 Pena ..... A47K 10/38 242/560.3
3,374,042 A * 3/1968 Smith ..... A47K 10/38 312/34.22

(Continued)

*Primary Examiner* — Michael R Mansen
*Assistant Examiner* — Raveen J Dias
(74) *Attorney, Agent, or Firm* — Sanchelima & Associates, P.A.; Christian Sanchelima; Jesus Sanchelima

(57) ABSTRACT

The present invention is a toilet paper dispensing device having loading means located at an upper intake portion of the housing to permit introduction of paper rolls into the housing therefrom. Toilet paper rolls are stored and released into a lower compartment having locking means for rotatably engage a paper roll being used and releasable mounted within a lower dispensing portion of the housing to cooperatively permit a user to pull the paper from said paper roll being used; upon the toilet paper roll in use, a user can remove the empty roll using a door on the housing and actuate a lever to allow the next toilet paper roll in line to fall into the lower compartment and be held in place by hook members so a user can easily grab toilet paper from the lower compartment.

10 Claims, 9 Drawing Sheets

(56) References Cited

U.S. PATENT DOCUMENTS 3,580,651 A * 5/1971 Gauper ..... A47K 10/3827 312/34.22
4,034,924 A * 7/1977 Carlisle ..... A47K 10/40 242/560.3
4,098,469 A * 7/1978 McCarthy ..... A47K 10/38 242/560.3
4,108,389 A * 8/1978 Womack ..... A47K 10/38 242/560.3
4,520,968 A * 6/1985 Shpigelman ..... A47K 10/38 225/47
4,564,148 A * 1/1986 Wentworth ..... A47K 10/38 242/560.3
4,944,466 A * 7/1990 Jespersen ..... A47K 10/3687 242/560.3
5,000,393 A * 3/1991 Madsen ..... A47K 10/38 221/297
5,271,574 A * 12/1993 Formon ..... A47K 10/36 242/560.3
5,558,302 A * 9/1996 Jesperson ..... A47K 10/3687 242/560
5,597,133 A * 1/1997 Teague ..... A47K 10/38 221/102
5,765,719 A * 6/1998 Upham ..... A47K 10/38 221/194
5,868,335 A * 2/1999 Lebrun ..... A47K 10/38 242/560.3
6,062,422 A * 5/2000 Ellis ..... A47K 10/3827 221/45
6,161,794 A * 12/2000 Cravatt ..... A47K 10/38 242/560
6,508,432 B2 * 1/2003 Krivulin ..... A47K 10/3836 242/558
7,191,976 B1 * 3/2007 Jensen ..... A47K 10/22 242/560.3
9,408,504 B1 * 8/2016 Cordeau ..... A47K 10/22
2003/0080237 A1 * 5/2003 Taylor ..... A47K 10/38 242/596.7
2003/0127554 A1 * 7/2003 Ozimec ..... A47K 10/3809 242/590
2006/0186257 A1 * 8/2006 Rigas ..... A47K 10/40 242/560.2
2007/0181738 A1 * 8/2007 Demers ..... A47K 10/38 242/597.8
2007/0221777 A1 * 9/2007 Valot ..... A47K 10/36 242/560
2009/0308966 A1 * 12/2009 Hjort ..... A47K 10/38 242/558
2011/0042503 A1 * 2/2011 Hagleitner ..... A47K 10/3687 242/560
2016/0037978 A1 * 2/2016 Granados ..... A47K 10/22 242/560.3
2017/0251890 A1 * 9/2017 Groover ..... A47K 10/38
2018/0084953 A1 * 3/2018 Gottschalk ..... A47K 10/38

* cited by examiner

PAPER ROLL DISPENSING DEVICE

BACKGROUND OF THE INVENTION

1. Field of the Invention

The present disclosure generally relates to a device for providing storage and dispensing of paper rolls, such as toilet paper rolls, as required.

2. Description of the Related Art

In toilets, especially those located in public buildings and the like, paper rolls, such as toilet paper rolls, are used in large quantities which often result in complete discharge of paper from the paper roll in place in a paper roll holder, very frequently. Usually extra or spare paper rolls are stored separately so as not to be easily available to children, vandals and the like who may lead to wastage of tissue paper from the rolls. In order to maximize counter top space available in a household, these rolls are usually stored out of sight (e.g. in storage closets etc.). This practice is problematic particularly in the case of toilet paper rolls because a fresh toilet paper roll may not be easily available to an individual in a time of need who may be faced with the unfortunate occurrence of an empty paper roll. It is often the responsibility of a caretaker to replenish the roll holder with a fresh paper roll after the previous paper roll has been completely discharged of tissue paper. However, caretakers are only available during specified periods, generally after working hours, so it is often a problem to always maintain a replenished paper roll in the paper roll holder. Thus, it is imperative that any person without the assistance of a caretaker may easily replenish these extra or stored rolls.

Previous attempts to address this issue have resulted in large, bulky dispensing units that hold a gigantic roll of toilet paper, display numerous rolls of paper simultaneously, or otherwise make access to additional rolls difficult for the user due to additional rolls being accessible only by key. Further, it is common for previously existing dispensers to inadequately allow a user to remove individual sheets from the toilet paper roll without the new roll binding on the surface of the dispenser, the finished roll, or other material in the dispensing area.

For instance, U.S. Pat. No. 6,062,422 ('422 patent) discloses a paper roll dispenser comprising an upright elongate tubular member having an upper inlet port, a lower discharge port, and a tubular passageway coupled to and extending between the inlet port and the discharge port; and an elongate member provided in the tubular passageway. An actuator is coupled to the elongate member for pivoting the elongate member about an axis transverse to the longitudinal axis of the tubular member, between a first position wherein the elongate member obstructs the tubular passageway and a second position wherein the elongate member does not obstruct the tubular passageway. The paper roll dispenser of '422 patent may allow to dispense a new paper roll when required, but it requires that the dispensed new paper roll may manually be placed in the paper roll holder by replacing the previous exhausted paper roll, which may be cumbersome, and sometimes may not even be desirable, for some users.

Therefore, there is a need to provide a dispensing device, which can provide storage, and dispensing of paper rolls, while allowing replacement of the old exhausted paper roll with ease with and with minimal manual effort. Documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a dispensing device which can provide storage and dispensing of paper rolls, and allow replacement of a paper roll in the operating position when it has been exhausted or used up following a simple hand operation performed by a user.

It is yet another objective of the present invention to provide a dispensing device which can provide simple procedure for loading of new paper rolls therein, by simply inserting the new roll through the top of the device after having opened a top lid thereof, to store paper rolls and facilitate the refilling of paper rolls.

It is still another objective of the present invention to provide a dispensing device having a larger range of supply, higher service continuity and less maintenance problem while being cost-effective to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
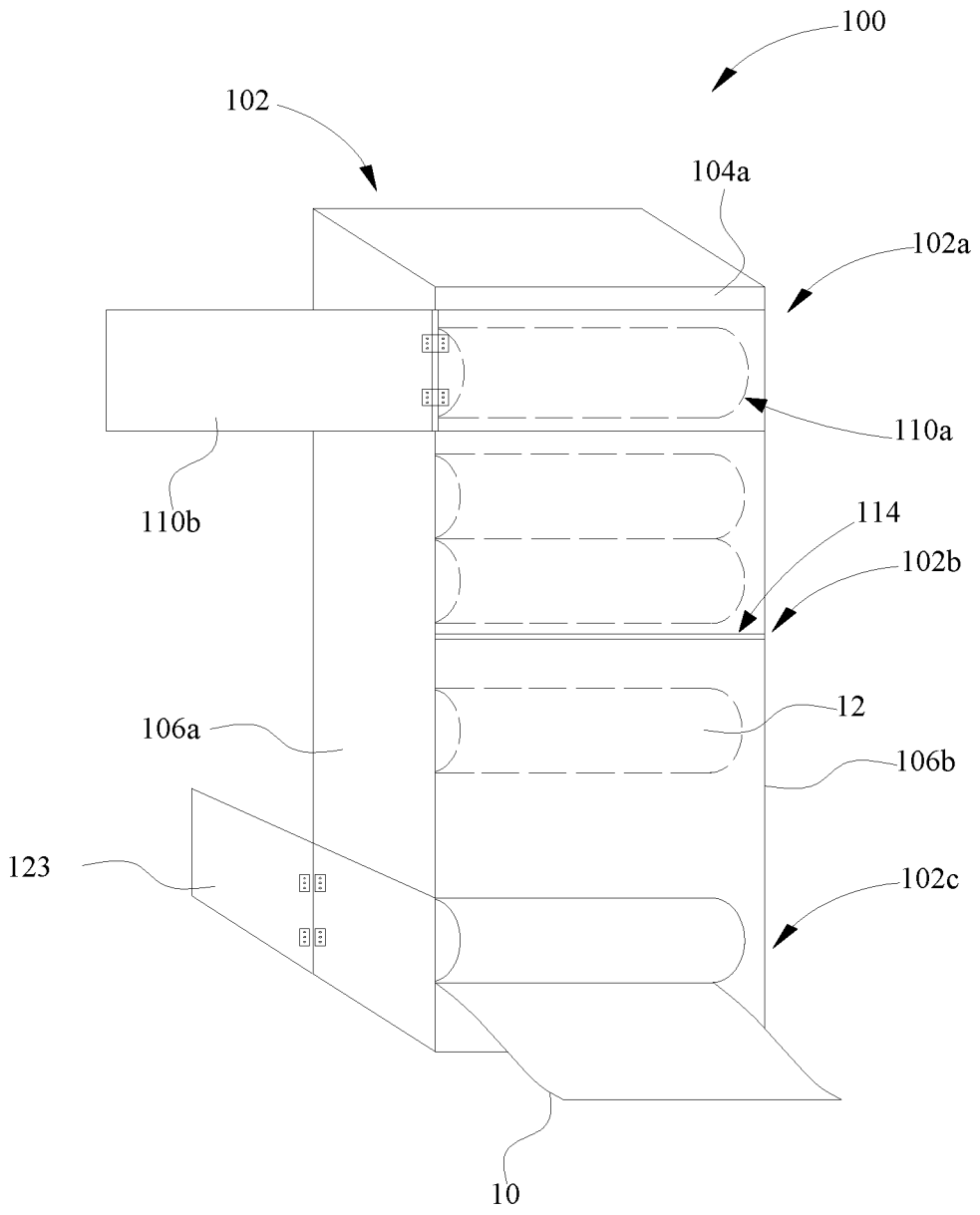
FIG. 1 illustrates a diagrammatic front perspective view of a dispensing device 100, in accordance with one or more embodiments of the present invention
Figure 2:
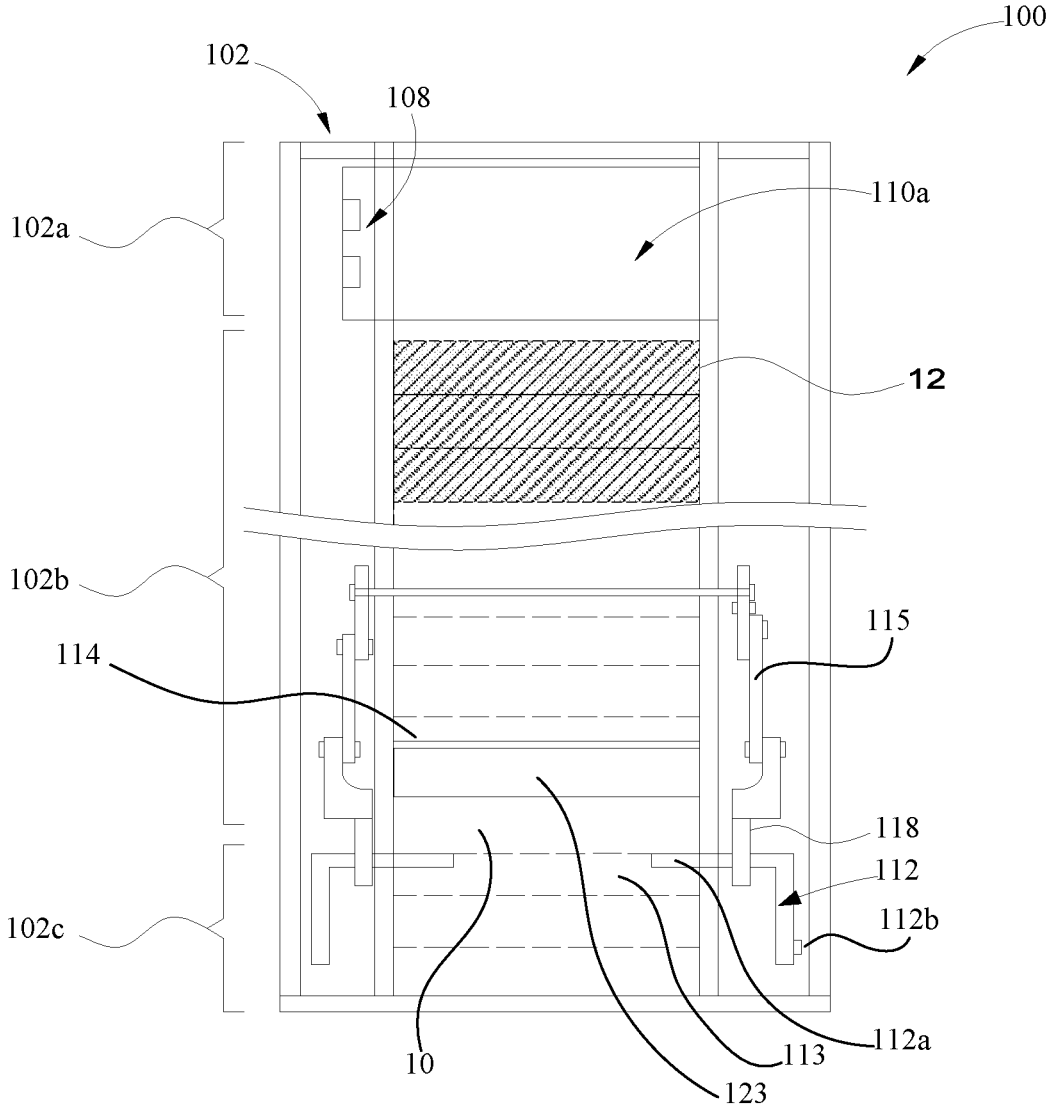
FIG. 2 illustrates a see-through front view of the dispensing device 100 showing inside of housing 102 thereof, in accordance with one or more embodiments of the present invention.
Figure 3:
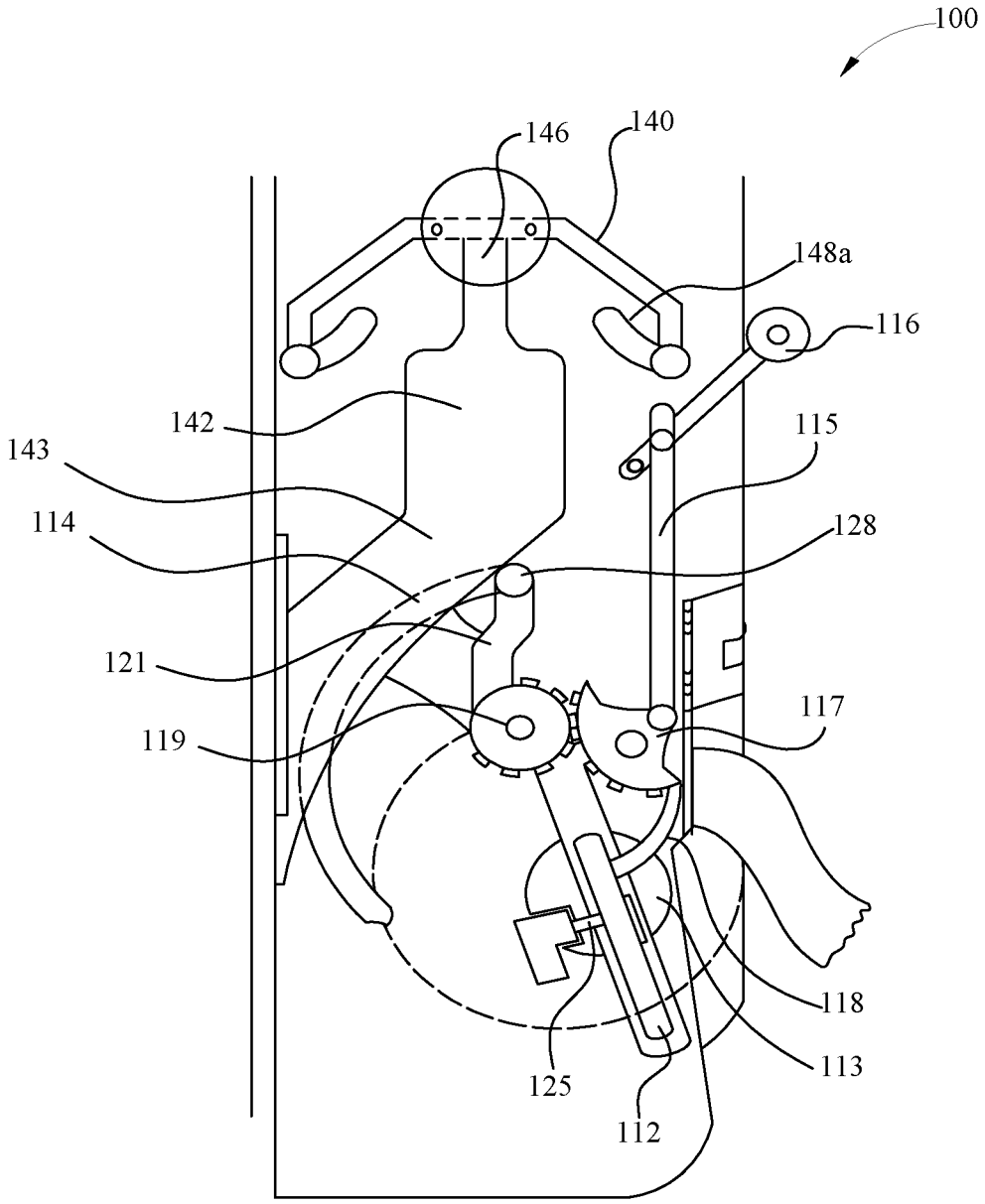
FIG. 3 illustrates a side see-through view of, housing 102, showing releasing assembly 140 of the dispensing device 100, in accordance with one or more embodiments of the present invention.
Figure 4:
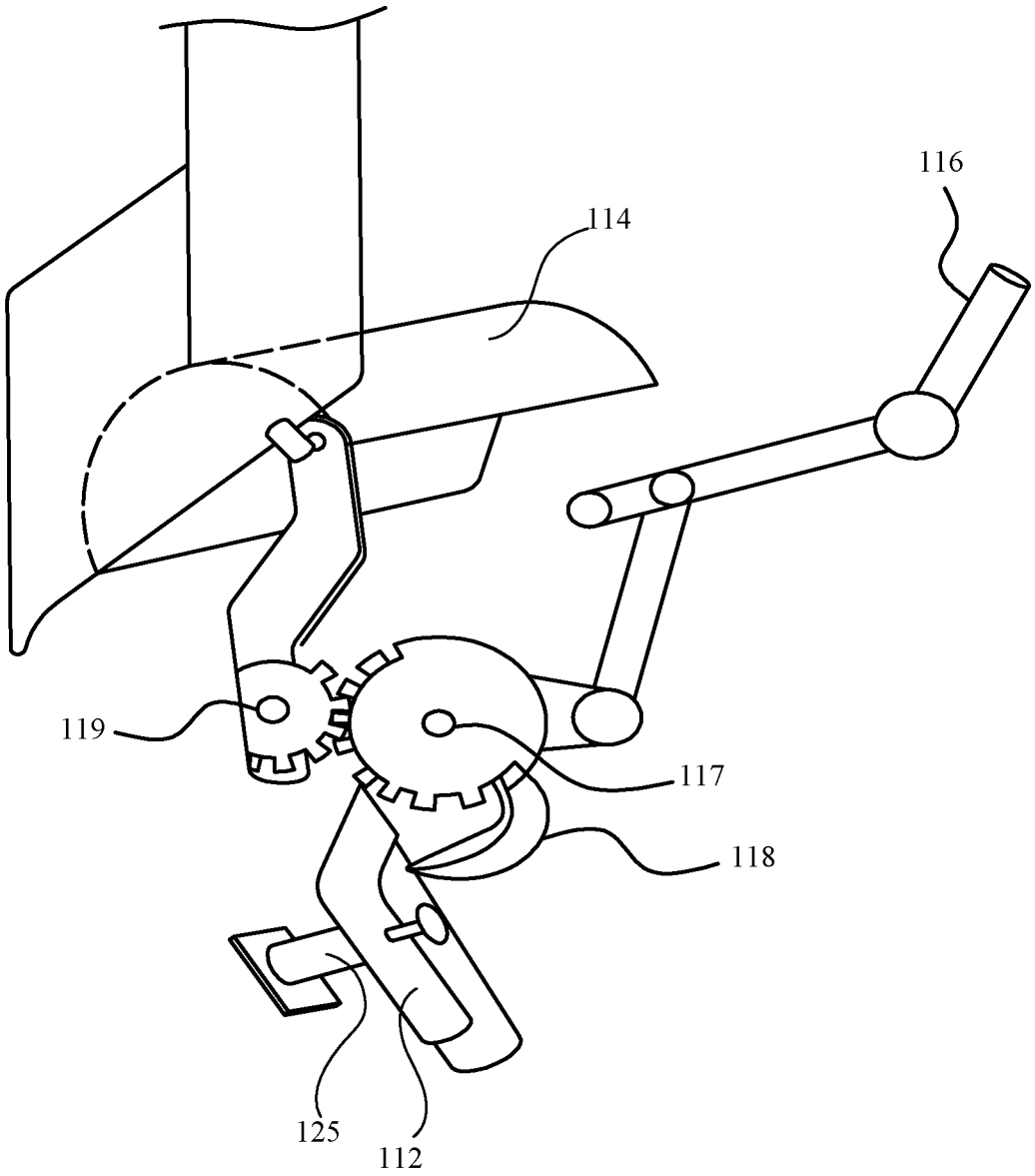
FIG. 4 illustrates several of the components of the present invention and shows how gears 117 and 119 work together with their respective parts, in accordance with one or more embodiments of the present invention.
Figure 5:
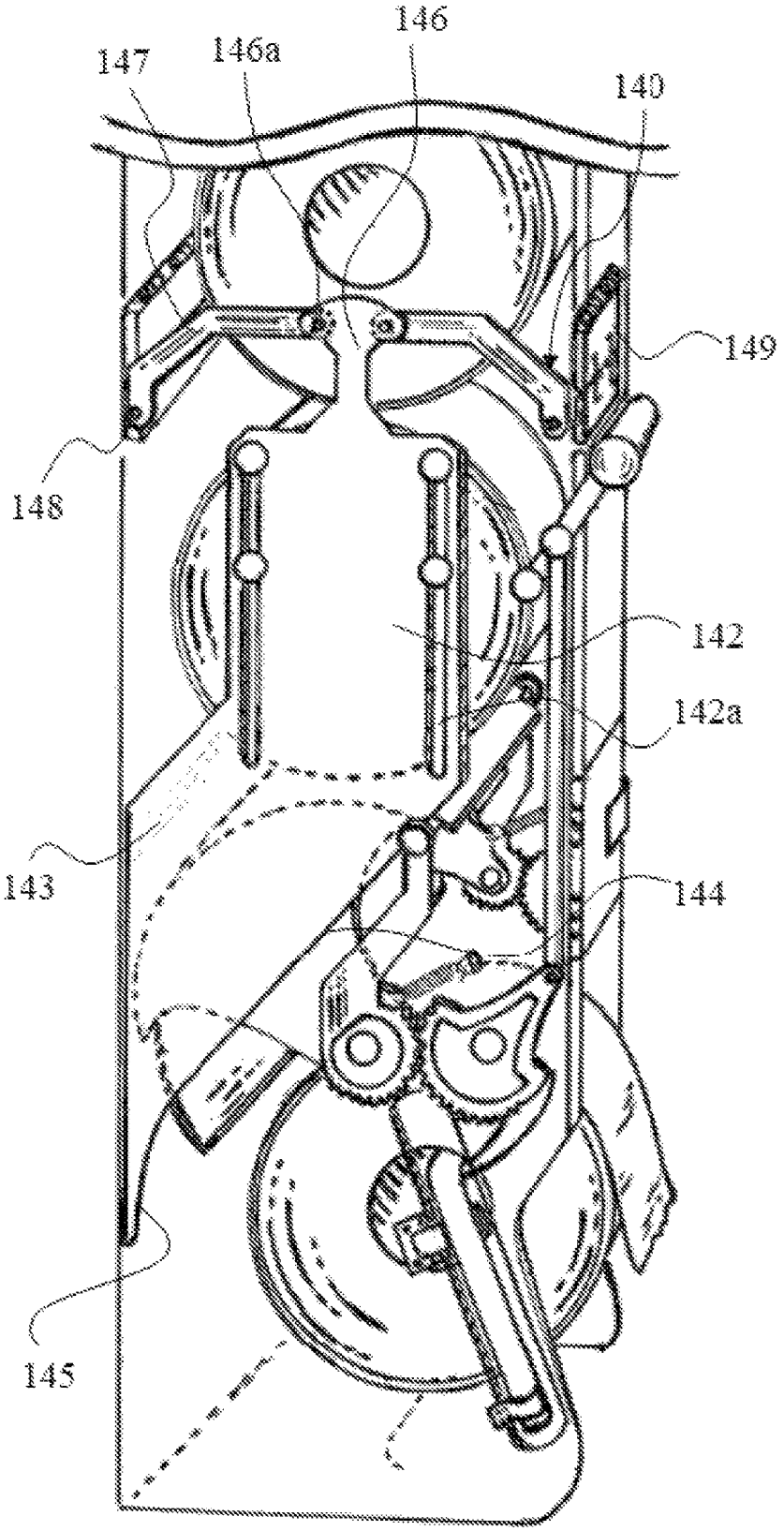
FIGS. 5-5A illustrate diagrammatic views of different compartments of the dispensing device 100, in accordance with one or more embodiments of the present invention.
Figure 5A:
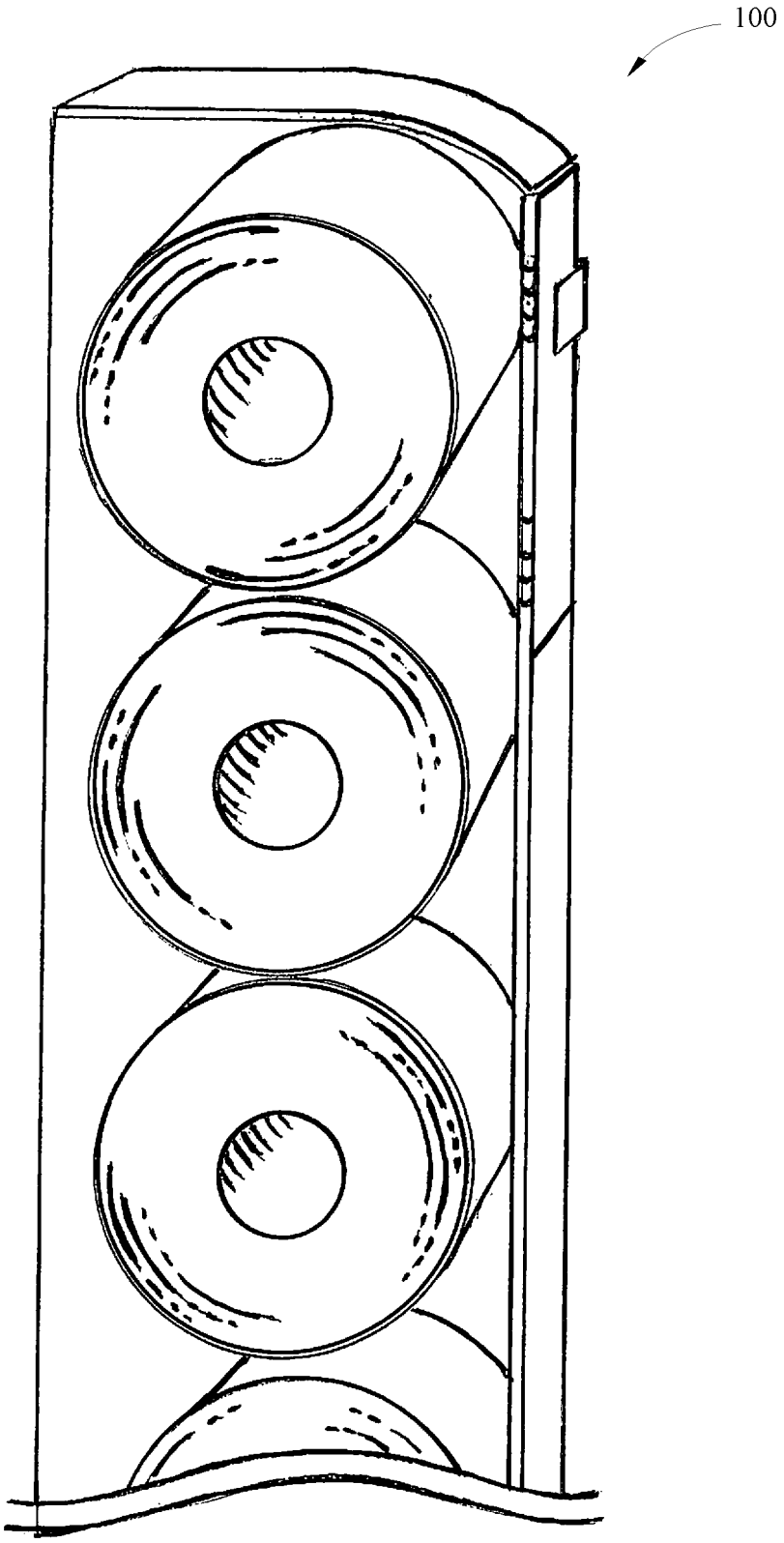
Figure 6:
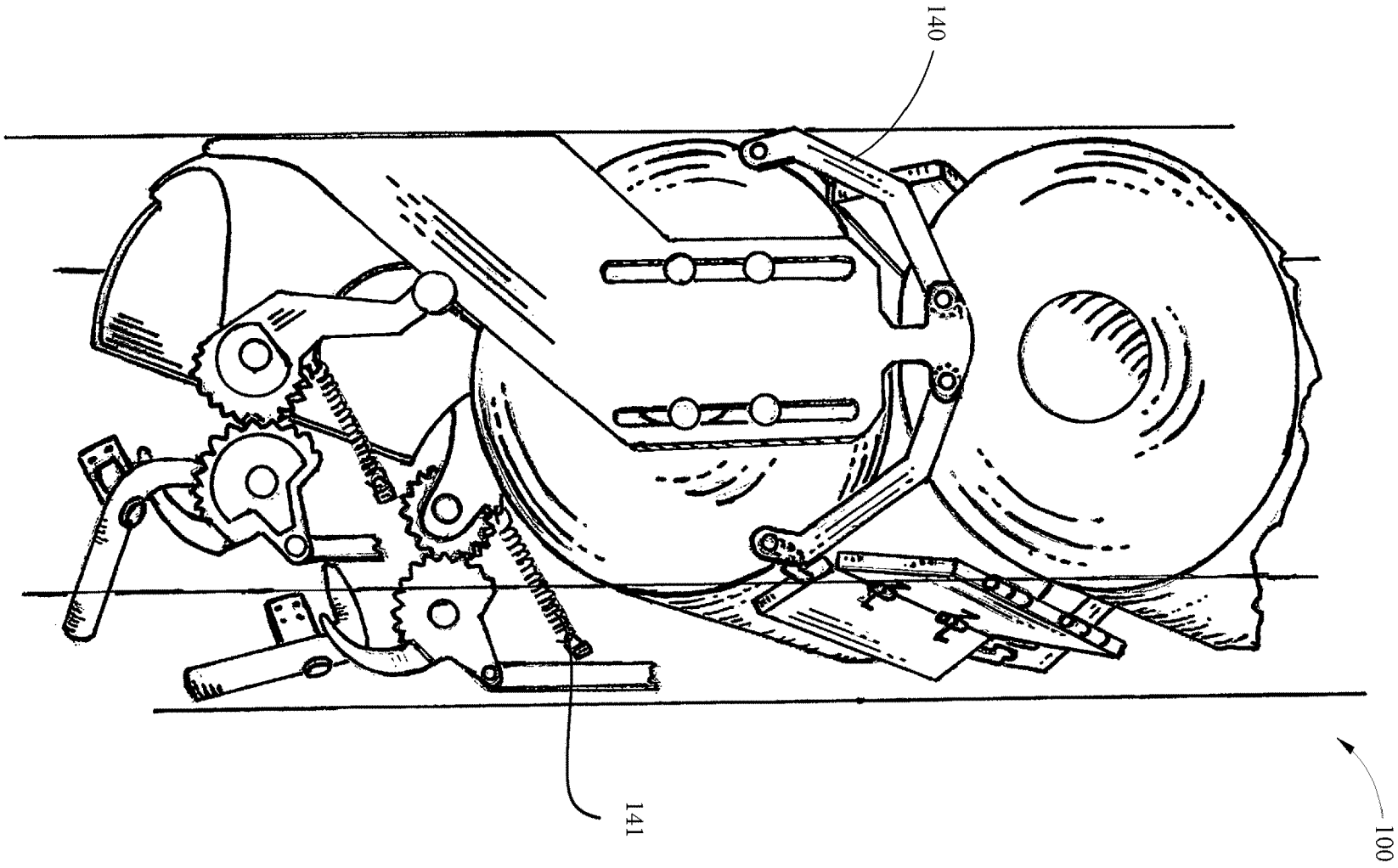
FIG. 6 shows a side see through view of housing 102 showing releasing assembly 140, support means 114 and locking means 112. Here, the paper roll has not been fully locked by locking means 112.
Figure 7:
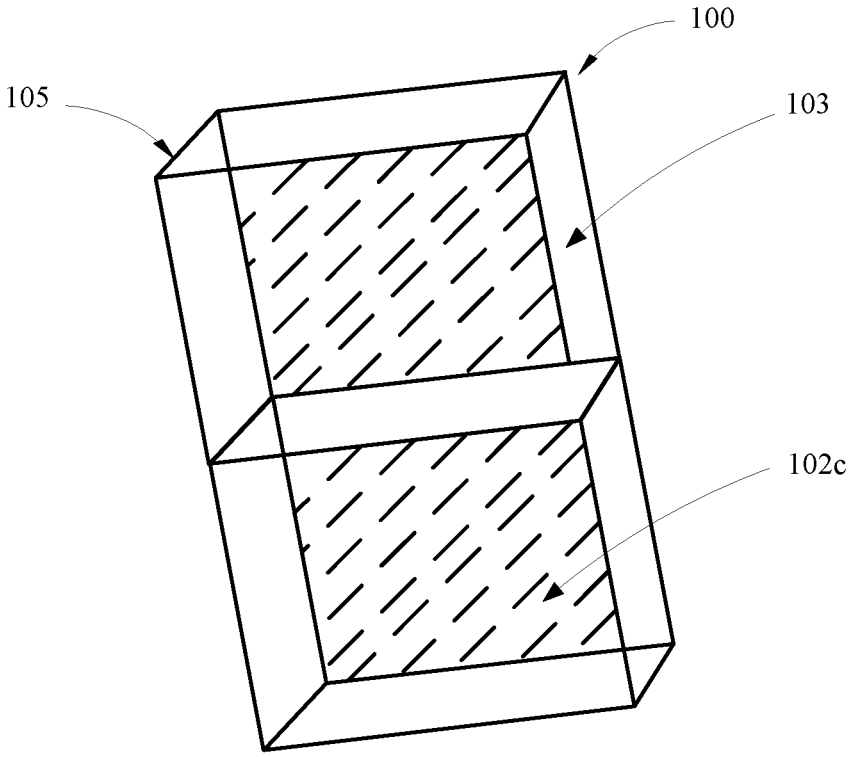
FIG. 7 shows housing 102 having inner shell 103 and outer shell 105.

Referring to the drawings, FIGS. 1-2 illustrates diagrammatic views of a dispensing device (generally designated by the numeral 100), in accordance with embodiments of the present disclosure. The dispensing device 100 is adapted to supply paper portions of a predetermined or user-adjustable length, to be used as towels, tissues, and so on. The dispensing device 100 is usually installed in lavatory areas for communities or social premises like coffee, shops, bars, restaurants, and so on. In other examples, the dispensing device 100 may be installed in kitchens and bathrooms or the like, to supply portions of paper. In these cases, paper usage is rather fast, and a problem which has constantly to be faced is the availability of a spare roll which can be readily replaced in order to avoid any out of service condition due to the device being out of paper, and the present dispensing device 100 provides convenient solution to such issues.

As illustrated in FIG. 1, the dispensing device 100 includes a housing 102 extending upright a first predetermined distance (i.e. height). The housing 102, of the dispensing device 100, is preferably made of a plastic material with a certain mechanical strength. The housing 102 includes a front wall 104*a* and a rear wall 104*b*, such that the front wall 104*a* and the rear wall 104*b* are coextensive with each other. The housing 102 further includes a first sidewall 106*a* and a second sidewall 106*b*. Herein, the front and rear walls 104*a*, 104*b* are kept at a parallel and spaced apart relationship with respect to each other, and perpendicularly disposed with respect to the first and second side walls 106*a*, 106*b* that are also kept at parallel and spaced apart relationship with respect to each other, imparting the housing 102 a substantially rectangular shape. Generally, the rear wall 104*b* may possibly be provided with known means on a backside thereof (not shown) for fastening the dispensing device 100 to a support wall.

In the present embodiments, the housing 102 have an upper intake portion 102*a*, a middle storage portion 102*b* and a lower dispensing portion 102*c*. As may be seen from FIG. 1 and further in reference to FIG. 2, the dispensing device 100 includes loading means 108 located at the upper intake portion 102*a*, and having cooperative dimensions to permit introduction of paper rolls into the housing 102 therefrom. In particular, the front wall 104*a* may have an opening 110 defined in the upper intake portion 102*a* with predetermined dimensions to permit a horizontally disposed paper roll to pass there through. In some examples, the opening 110*a* may be closed/covered (when required) using a lid, such as a loading door 110*b*, hinged coupled to the housing 102 at the upper intake portion 102*a* to be disposed between an open position (as shown in FIG. 1) and a closed position (as may be seen from FIG. 2). Further, the dispensing device 100 includes toilet paper roll locking means 112 for rotatably supporting a paper roll, such as a paper roll 10, being used and releasably mounted within said lower dispensing portion 102*c* to cooperatively permit a user to pull the paper from the paper roll 10 being used. Locking means 112 includes a hook 112*a* that goes through toilet paper inner tube 113 to hold one toilet paper roll at a time. Stopper 112*b* can be included to limit the rotation of locking means 112. Housing 102 includes toilet paper roll retrieval door 123 that allows a user to remove an empty toilet paper roll from hooks 112*a*. Door 123 also stops a user from removing an empty toilet paper roll from hooks 112*a*. Door 123 also stops a toilet paper roll from falling out of housing 102 as it travels from middle to lower compartment 102*c*.

Also, the present dispensing device 100 includes supporting means 114 for supporting at least one paper roll housed within the middle storage portion 102*b* and at a vertical spaced apart relationship with respect to the paper roll 10 being used. For instance, as shown in FIG. 2, the middle storage portion 102*b* includes a plurality of stored paper rolls 12 being stored therein. It may be appreciated that both of the said paper rolls 10 and 12 may be of the cardboard core type. Further, the dispensing device 100 includes an actuating means 116 that protrudes outwardly from the housing 102 for actuating the supporting means 114 to dispense the at least one stored toilet paper roll 12 from the middle storage portion 102*b* to the lower dispensing portion 102*c* to be rotatably supported by the locking means 112 therein. The structural and mechanical configuration of the various operational means in the dispensing device 100 has been explained in detail in the subsequent paragraphs with reference to FIGS. 3-6. Actuating means 116 can be a lever, a button, or similar element.

The present invention can include a housing 102 with an inner shell 103 where all components except supporting means 114 are mounted and an outer shell 105 that covers the components in the middle and bottom compartments 102*b* and 102*c*. Supporting means 114 is the only component that is located substantially inside the inner shell. According to embodiments of the present disclosure, the locking means 112 is in the form of a toilet paper roll holder rotatably mounted and extending inside in the lower dispensing portion 102*c*. The paper roll holder 112 may be hingedly mounted to holder raising members 118, that are each mounted to a first gear 117 and thereby raise the holder raising member 118 when the actuating means 116 is activated, hinged members 115 urge the rotation of corresponding gear and thereby raise the holder raising member 118 to raise the supporting means by rotating 112 out of the way so that when a stored toilet paper roll 12 is dropped into the lower compartment 102*c* it can fall fully in place and level 114 is released hooks 112*a* are inserted into the new operational toilet paper toll 10.

Further, as illustrated in FIGS. 3-6, the releasing means 114 may include a curved, partially open shell that prevents the next in line stored toilet paper roll 12 from entering the lower portion 102*c*. First gear 117 is engaged with second gear 119 so that upon actuating means 116 being activated, second gear 119 rotates opposite to the first gear 117. Second gear 119 is mounted to rigid member 121 so that its bottom end is connected to guiding member 128 at its top end. Guiding member 128 is mounted to supporting means 114 so that as guiding member 128 moves it, it takes supporting means 114 with it along edge 144. Second gear 119 urges guiding member 128 to move through edge 144 until supporting means 114 is out of the way and stored toilet paper roll 12 can drop into lower portion 102*c* and become operational toilet paper roll 10. A spring 141 is connected from hinged members 114 to supporting means 114 to retract supporting means 114 into its initial position as actuating means 116 is released. As supporting means 114 is retracted, first and second gears 117; 119 are rotated in the opposite directions so that first gear 117 brings hooks 112*a* back into their initial positions to lock into the next operational toilet paper roll 10. Locking means 112 include hooks and shaft that is connected to axle 125 that permits its rotation. Supporting means 114 travels along hook slots. As the actuating means 116 is released, the holding members of the paper roll holder 112 are rotated towards the center of the housing 102 and are inserted into the openings of the paper roll 10 to hold it in place.

The dispensing device 100 of the present disclosure may be implemented to normally hold at least two paper rolls, wherein operational toilet paper roll 10, which is held in the lower dispensing portion 102*c* of the housing 102. Releasing assembly 140 includes vertical member 142 having slots 142*a* within its area. Vertical member 142 can be integrally mounted to diagonal member 143 that includes a diagonal bottom edge 144 that is in abutment with guiding member 128. As guiding member 128 travels along edge 144 it simultaneously pushes vertical member 142 upwards-using edge 144. Once vertical member has reached its vertical most point, edge 144 ends and guiding member 128 then travels along arched end 145 of diagonal member 143. Arched end 145 is so that support assembly 114 continues to clear out of the way for the incoming paper roll coining from middle compartment 102*b*, without continuing to raise vertical member 142. As vertical member 142 is pushed upwards it is kept in line by vertical guiding members, extension 146 can be mounted in a hinged manner to arms 147 using fastening members 146*a* so that as extension 146 travels upwards, arms 147 are inwardly urged. Arms 147 at their distal ends include arm-guiding members 148 connected through an arm slot 148*a* to flappers 149.

Figure 8:
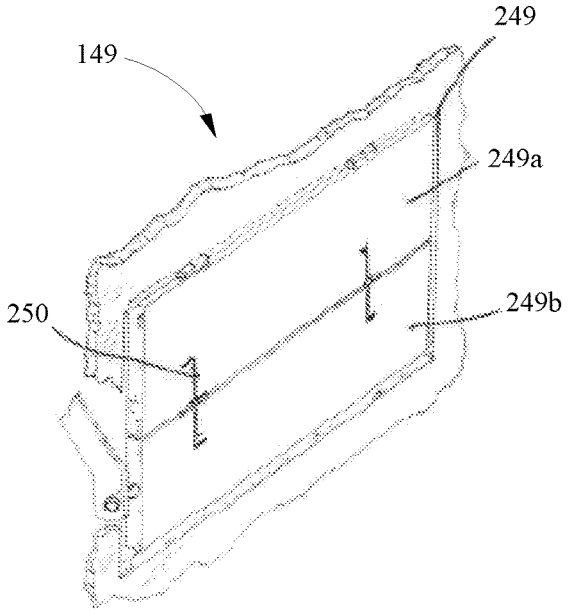
FIGS. 8-8C shows an alternate embodiment for flappers 149, namely flappers 149 in its different configurations.
Figure 8A:
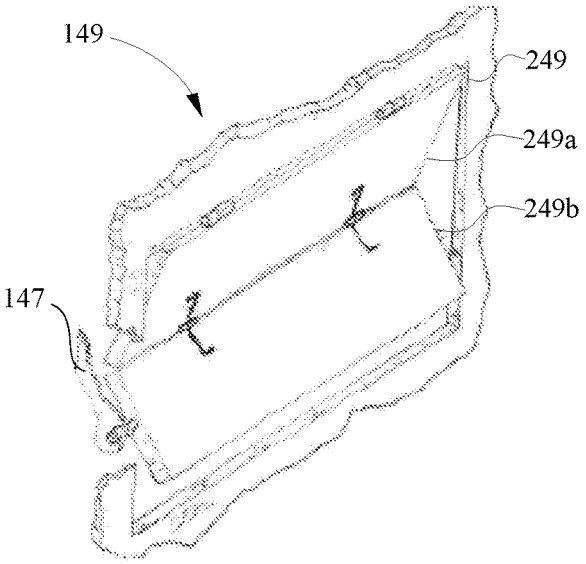
Figure 8B:
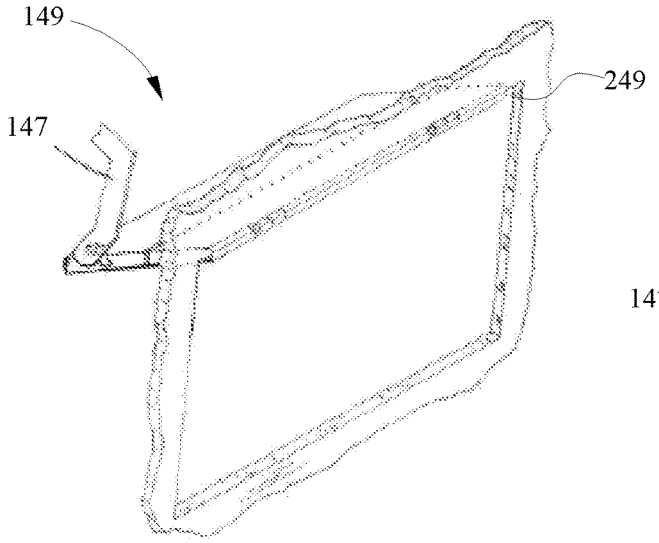
Figure 8C:
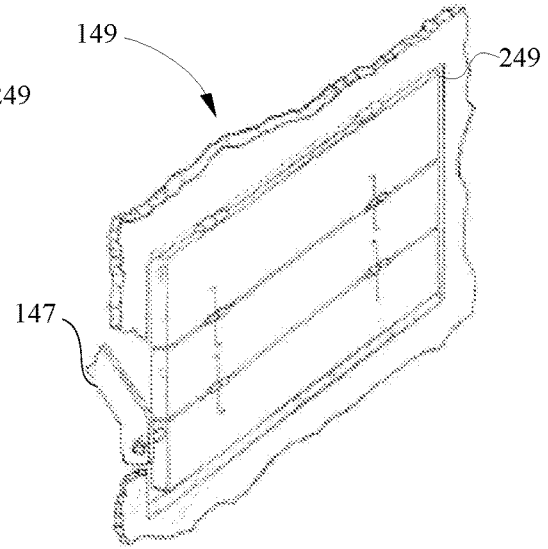

As actuating means 116 is activated, vertical member 142 is pushed upwards; arms 147 are urged inwardly causing arm-guiding members 148 to travel through arm slots 148*a*. As arm guiding members 148 travel they urge flappers 149 inwardly from a vertical position to a horizontal position. Flappers 149 divide housing 102 between its upper compartment 102*a* and its middle compartment 102*b*. Flappers 149 when urged into the horizontal position temporarily hold the next paper roll in line in upper compartment 102*a* and when actuating means 116 is released flappers 149 go back to their vertical position allowing that paper roll to fall into middle compartment 102*b*. An alternate embodiment of flappers 149, namely flappers 249 can be seen in FIGS. 8-8B wherein flappers 249 is defined by two mounted panels and can have three mounted panels 249*a*; 249*b* mounted in a hinged manner. FIG. 8C shows an alternate embodiment of flappers 149 using three panels. This is used for larger paper rolls that would impede flappers 249 from extending into their horizontal position. By being two panels that are mounted in a hinged manner using spring loaded attachment members 250 and flappers 249 can articulate to conform to larger paper rolls and allowing it to pass as it partially collapses about its hinged axis.

The dispensing device 100 of the present disclosure provides a larger range of supply of the paper rolls, and thereby provides higher service continuity and less maintenance problems. A spot-checking may be enough to replace the spare roll when the roll being used is exhausted. It is also possible to simply insert the new roll through the upper intake portion 102*a* of the housing 102 after having opened the loading door 110*b* of the opening 110*a* thereof. A better grip of the paper by the user is also provided in that the user is simply required to pull on the edge protruding freely out of the dispensing slot in the lower dispensing portion 102*c*.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A paper roll dispensing device, comprising:

a) a housing having an upper portion, a middle portion, and a lower portion;

b) said upper portion includes an opening adapted to allow a first stored paper roll to be inserted therein;

c) said lower portion includes a locking member having an engagement member that is adapted to be inserted inside an operational paper roll;

d) an actuating member having a lever protruding outwardly from said housing; said lever is connected to at least one first gear using hinged members, and said at least one first gear is also connected to said locking member using holder raising members;

e) a supporting member that holds a second stored paper roll; and a releasing assembly mounted to said supporting member;

f) wherein, upon actuation of the actuating member, said locking member is rotated out of said operational paper roll, thereby allowing said operational paper roll to be removed; said supporting member rotates to allow said second stored paper roll to drop into said lower portion; and said releasing assembly opens to allow said first stored paper roll to fall into said middle portion.

2. The device of claim 1, wherein said lower portion includes an opening adapted to allow a user to retrieve said operational paper roll engaged to said locking member.

3. The device of claim 1, wherein said lower portion includes a stopper that limits the rotation of said locking member.

4. The device of claim 1, wherein said opening is covered by a door.

5. The device of claim 1, wherein said releasing assembly includes two arms that are each connected to flappers; wherein, said flappers hold said first stored paper roll in the upper portion when the actuating member is actuated, and releases said first stored paper roll when the actuating member is released so that the first stored paper roll falls into the middle portion.

6. The device of claim 5, wherein said flappers are defined by at least two hingedly connected panels that conform to larger paper rolls.

7. The device of claim 1, wherein said releasing assembly includes a vertical member, and a second gear that cooperates with at least one first gear; and when the actuating member is actuated, said actuating member rotate said at least one first gear, which in turn rotates said second gear that rotates said supporting member; and said second gear is also connected to a guiding member that pushes said vertical member upwards as it travels along an edge of said vertical member.

8. The device of claim 1, wherein said releasing assembly includes two arms that include arm slots adapted to allow said two arms to articulate.

9. The device of claim 8, wherein said vertical member includes at least one slot that guide said vertical member upwards as it is urged by a guiding member mounted to a second gear, that is connected to at least one first gear, which is connected to said actuating member.

10. The device of claim 1, wherein said engagement member is a hook.

* * * * *